US006921288B2

(12) United States Patent
Blondin et al.

(10) Patent No.: US 6,921,288 B2
(45) Date of Patent: Jul. 26, 2005

(54) SEMICONDUCTOR TEST AND BURN-IN APPARATUS PROVIDED WITH A HIGH CURRENT POWER CONNECTOR FOR COMBINING POWER PLANES

(75) Inventors: John M. Blondin, Colchester, VT (US); Gene T. Patrick, Richmond, VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/707,169

(22) Filed: Nov. 25, 2003

(65) Prior Publication Data

US 2005/0112936 A1 May 26, 2005

(51) Int. Cl.[7] ..... H01R 31/08
(52) U.S. Cl. ..... 439/507; 439/134; 439/149
(58) Field of Search ..... 439/507–510, 439/707–710, 134, 149

(56) References Cited

U.S. PATENT DOCUMENTS

| | | | | |
|---|---|---|---|---|
| 2,830,353 A | | 4/1958 | Barlow | 24/125 |
| 3,917,371 A | * | 11/1975 | Hirokawa et al. | 439/52 |
| 4,147,446 A | | 4/1979 | Frank, Jr. | 403/390 |
| 5,014,002 A | | 5/1991 | Wiscombe et al. | 324/158 F |
| 6,309,246 B1 | | 10/2001 | Keaton et al. | 439/509 |

* cited by examiner

*Primary Examiner*—Truc Nguyen
(74) *Attorney, Agent, or Firm*—Francis J. Thornton; Robert A. Walsh

(57) ABSTRACT

A semi-conductor module burn-in test apparatus having a plurality burn-in boards each of which is provided a plurality of module test sockets thereon and each test socket is coupled to an adjacent test socket by with a high current, open/short split power connector that can readily connected to or disconnected from said adjacent test socket by coupling together the power inputs of the adjacent sockets or uncoupling the previously coupled power inputs of adjacent sockets and thereby selectively altering the current carrying levels available to said adjacent test sockets.

9 Claims, 6 Drawing Sheets

SEMICONDUCTOR TEST AND BURN-IN APPARATUS PROVIDED WITH A HIGH CURRENT POWER CONNECTOR FOR COMBINING POWER PLANES

BACKGROUND OF INVENTION

1. Field of the Invention

The present invention relates generally to semi-conductor module test apparatus using so called burn-in boards. More particularly, the present invention is directed to a high current, open/short power connector especially useful with such semiconductor module test and burn-in apparatus. An apparatus provided with the high power, open/short connector of the present invention can easily couple selected devices on the burn-in-board to significantly higher power levels.

2. Background of the Invention

As is well known to the art, integrated circuits modules have a number of signal interface points or pins, herein after referred to as input/output pins, that are used to transfer data, in the form of electrical signals, into or out of the integrated circuits modules. During operation a select number of these pins are used to introduce the necessary functions such as the circuit clocks, test modes, test control data, and etc. to the integrated circuit while other signal interface pins are used to transfer data into and out of the data storage circuits contained in the integrated circuit. These pins are arranged in a particular pattern called a footprint.

One test operation required during the manufacture of such modules is the so called burn-in test performed by placing the modules to be tested on burn-in-boards (BIBs) and powering up the modules while simultaneously heating the burn-in-boards in an oven. Typically the oven are designed to accommodate sixteen to thirty-two burn-in-boards. Each burn-in-board is typically comprised of a board having a plurality of sockets or power planes. Each such socket is adapted to accept therein the footprint of the module to be tested. Each such socket or power plane is thus designed to accommodate a specific type of semi-conductor integrated circuit and each burn-in-board is designed such that when it is placed in the burn-in oven each socket or power plane is electrically connected to suitable signal lines and power sources such each module on the burn-in-board can be properly energized. Presently, many semiconductor modules having a particular footprint are tested in these burn-in boards and draw less than 75 amperes of current from the power sources during this burn-in process. Other modules having the same footprint will require a current draw in excess of 75 amperes. Because of the operating characteristics of the burn-in ovens, if a module being tested exceeds the 75 amperes draw they will be considered failures due to over current conditions even though they are not failures. For this reason the higher current drawing modules cannot use the same power planes as the lower current drawing modules and vice versa. Thus, at present, each type of module depending on its current draw requires its own burn-in-board. For this reason the prior art required a multiplicity of burn-in-boards for each board was designed to accommodate a specific module and current draw. Thus a large number of burn-in-boards is required and this multiplicity of boards results in increased capital costs as well as costs due to the need for storage space and maintenance for the additional boards. All of these factors increase the cost of testing the modules. Further there is always a possibility that the wrong power plane could be used resulting in erroneous results which require either retesting or scrapping of the modules so tested. Thus there are compelling economic reasons to be able to easily convert a burn-in-boards power plane current carrying capacity to different levels.

Accordingly the present invention is designed to circumvent these difficulties and does so by providing each burn-in-board with a means for altering the applied current levels of selected ones of the power planes between current desired levels.

SUMMARY OF INVENTION

The present invention is directed to a novel burn-in-board provided with power planes for testing semiconductor devices, in which current connection means are selectively placed between the power planes for altering the current carrying levels of selected ones of the power planes.

Initially this is achieved by coupling together selected pairs of the power inputs of selected planes such that one of the selected power planes can be coupled with another to provide twice the power level for which the power plan was intended to be operated. In a first embodiment, the present inventors accomplished this by mounting fixed connectors between selected pairs of the power planes. In a second embodiment a unique split connector is mounted between selected pairs of the power planes.

These objects, features and advantages of the present invention will be become further apparent to those skilled in the art from the following detailed description taken in conjunction with the accompanying drawings wherein:

DETAILED DESCRIPTION

Referring now to FIGS. 1 through 7 the present invention will be described in detail.

Figure 1:
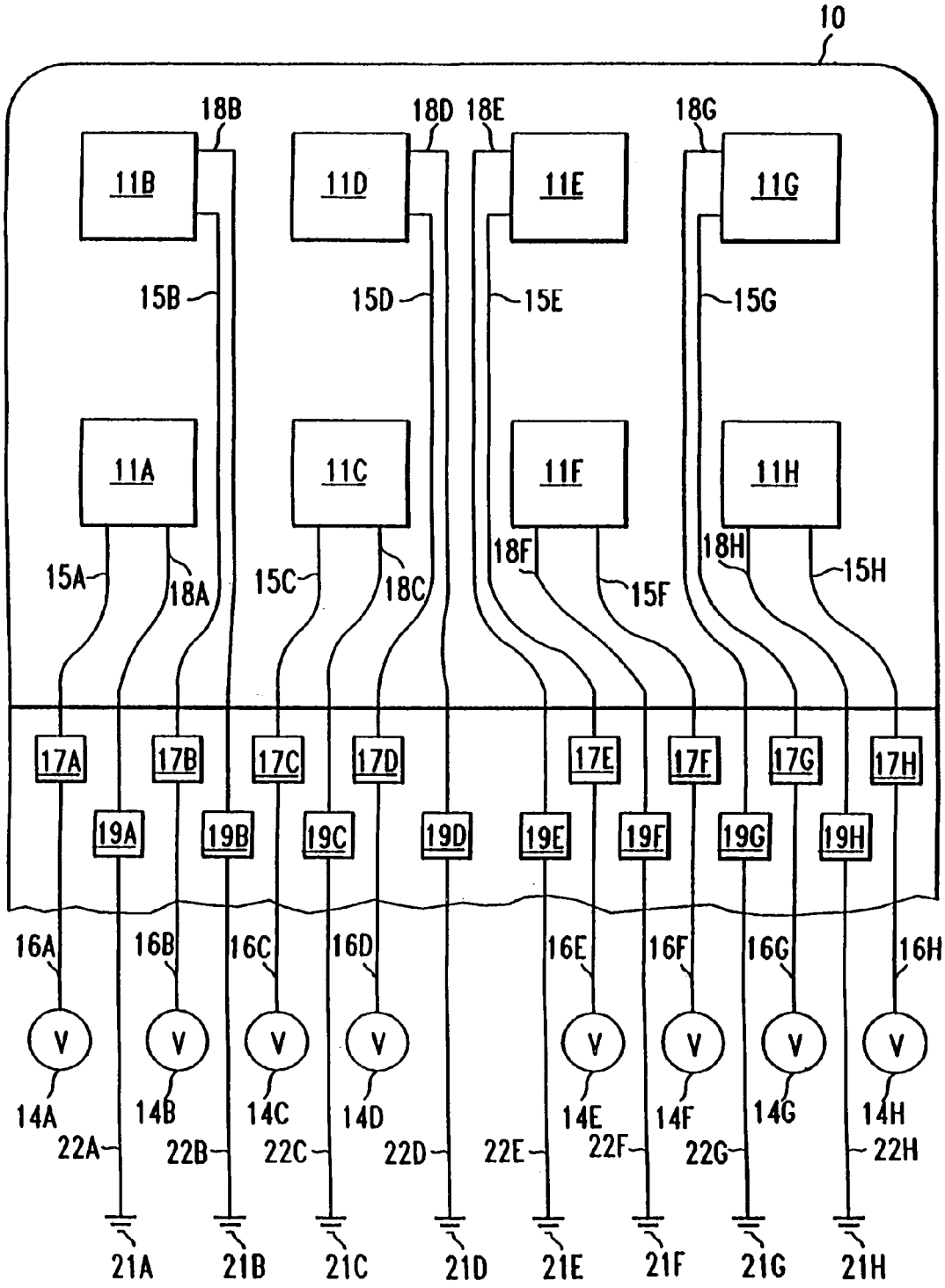
FIG. 1 is a schematic view of a typical prior art burn-in board.

FIG. 1 is a schematic view of a typical prior art burn-in board (BIB) and comprises a burn-in board 10 that typically has eight semiconductor module sockets or planes, 11A, 11B, 11C, 11D, 11E, 11F, 11G, and 11H Thereon. Each semiconductor module socket or plane, 11A, 11B, 11C, 11D, 11E, 11F, 11G, and 11H is coupled to a respective external power source 14A, 14B, 14C, 14D, 14E, 14F, 14G, and 14H via a respective power cable 15A, 15B, 15C, 15D, 15E, 15F, 15G, and 15H, a respective power coupling contact or plate 17A, 17B, 17C, 17D, 17E, 17F, 17G, and 17H and a respective external power cable 16A, 16B, 16C, 16D, 16E, 16F, 16G, and 16H. Each semiconductor module socket or plane, 11A, 11B, 11C, 11D, 11E, 11F, 11G, and 11H is also coupled to a respective ground coupling contact 19A, 19B, 19C, 19D, 19E, 19F, 19G, and 19H via a respective cable 18A, 18B, 18C, 18D, 18E, 18F, 18G, and 18H and to an external ground contact 21 via an external cable 22A, 22B, 22C, 22D, 22E, 22F, 22G, and 22H. Each socket or plane 11 is also coupled to a plurality of additional control and signal lines (not shown). For example, as shown FIG. 1, plane 11A is coupled to an external current source 14A via a power line 15A, coupling point 17A and external cable 16A and to ground 21A via a ground line 18A, a ground line coupling point 19A and an external cable 22A. The other planes 11B, 11C, 11D, 11E, 11F, 11G, and 11H are similarly coupled to their respective current sources and ground contacts. Thus plane 11B is coupled to an external current source 14B via a power line 15B, coupling point 17B and external cable 16B and to ground 21 via a ground line 18B, a ground line coupling point 19A and an external cable 22A; plane 11C is coupled to an external current source 14C via a power line 15C, coupling point 17C and external cable 16C and to ground 21 via a ground line 18C, a ground line coupling point 19C and an external cable 22C; plane 11D is coupled to an external current source 14D via a power line 15D, coupling point 17D and external cable 16D and to ground 21 via a ground line 18D, a ground line coupling point 19D and an external cable 22D; plane 11E is coupled to an external current source 14E via a power line 15E, coupling point 17E and external cable 16E and to ground 21 via a ground line 18E, a ground line coupling point 19E and an external cable 22E; plane 11F is coupled to an external current source 14F via a power line 15F, coupling point 17F and external cable 16F and to ground 21 via a ground line 18F, a ground line coupling point 19F and an external cable 22F; plane 11G is coupled to an external current source 14G via a power line 15G, coupling point 17G and external cable 16G and to ground 21 via a ground line 18G, a ground line coupling point 19G and an external cable 22G; and plane 11H is coupled to an external current source 14H via a power line 15H, coupling point 17H and external cable 16H and to ground 21 via a ground line 18H, a ground line coupling point 19H and an external cable 22H.

Figure 2:
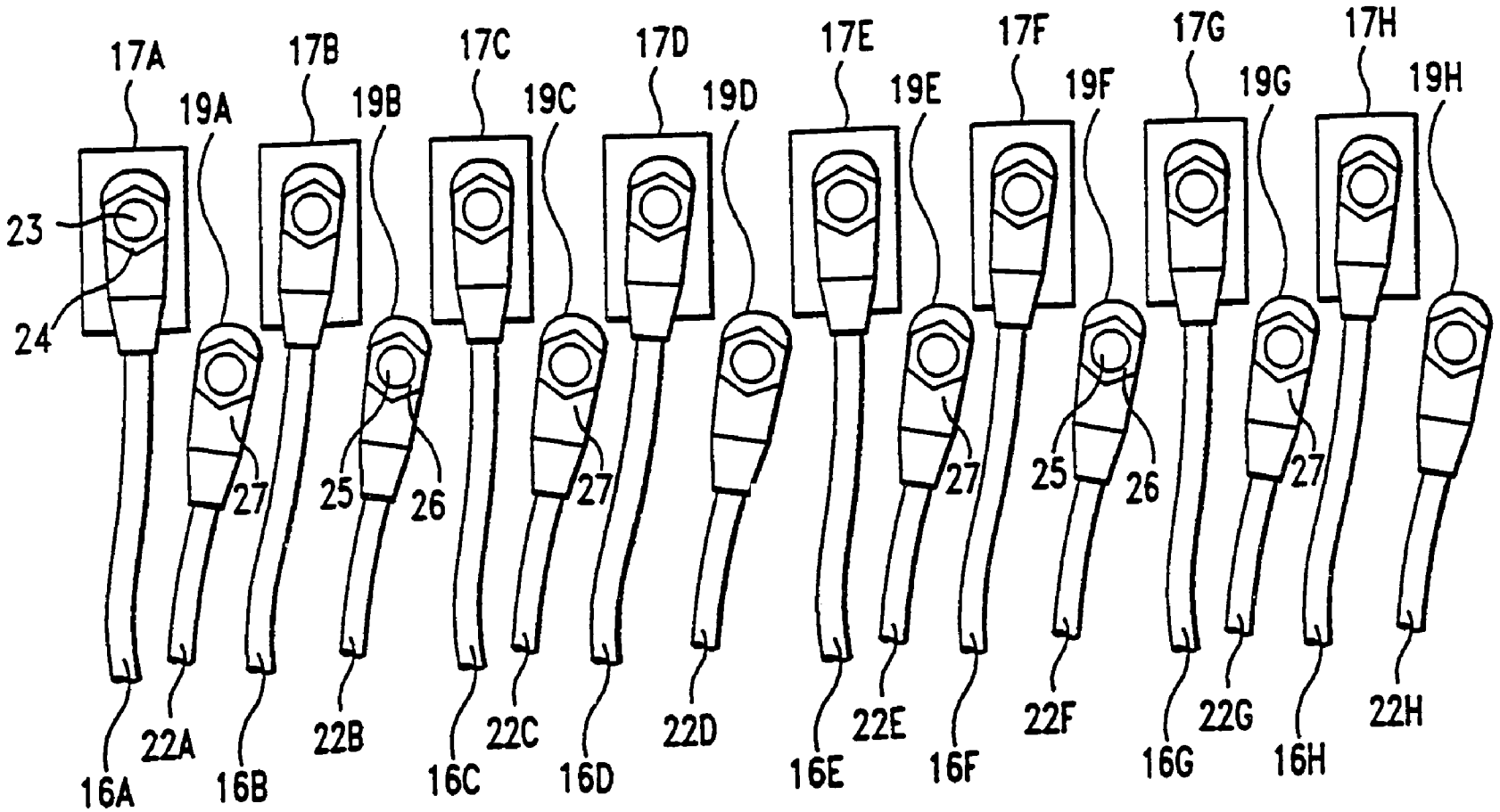
FIG. 2 is a top view of the power inputs of a typical prior art burn-in board.

FIG. 2 is an enlarged detailed partial top view of the external power lines 16A through 16H and external ground lines 22A through 22H and their respective coupling points 17A through and 19A through 19H as shown in FIG. 1. Each power plane 11 is connected the current source 14 through a respective external power line 16 by securing the respective external power line 16 to a respective current carrying power point 17. This is accomplished by providing each current carrying point 17 with a threaded stud or bolt 23 and securing the external line 16 to the current carrying power point by threading a nut onto the bolt 23. Each plane is similarly coupled to a respective ground line coupling point by a similar, bolt 25 and nut 26 arrangement.

Specifically, current carrying coupling points 17A, 17B, 17C, 17D, 17E, 17F, 17G, and 17H are bolted to respective power input lines 16A, 16*b*, 16C, 16D, 16E, 16F, 16G, and 16H via a lug 19 affixed to the end of each input line 16A, 16*b*, 16C, 16D, 16E, 16F, 16G, and 16H by a respective nut 23 and bolt 24 and the ground line coupling points 19A, 19B, 19C, 19D, 19E, 19F, 19G, and 19H are secured to the ground contacts 21 via a lug 27 affixed to the end of each cable 22 and a nut and a bolt.

Such burn-in boards are currently commercially available, from sources such as the Micro-Control Company of Minneapolis, Minn. and sold under the designation HPB-2. Thus their use is well known to the art and further description of such boards is believed to be unnecessary.

In the standard prior art burn-in boards each respective external power cable 16A, 16B, 16C, 16D, 16E, 16F, 16G, and 16H supplies only 75 amps to each respective plane or socket disposed thereon. However, as above discussed, this current level can be inadequate for some of the desired tests or modules and a higher current level was needed to properly test the modules.

The present invention resolves the above described problem by altering the burn in boards so that modules inserted in selected ones of the power planes can be operated above 75 amps but less than 150 amps. The present invention does this by selectively altering selected connections on the burn-in boards to permit selected one of the power planes to operate modules placed thereon to operate a power levels twice that normally permitted.

Figure 3:
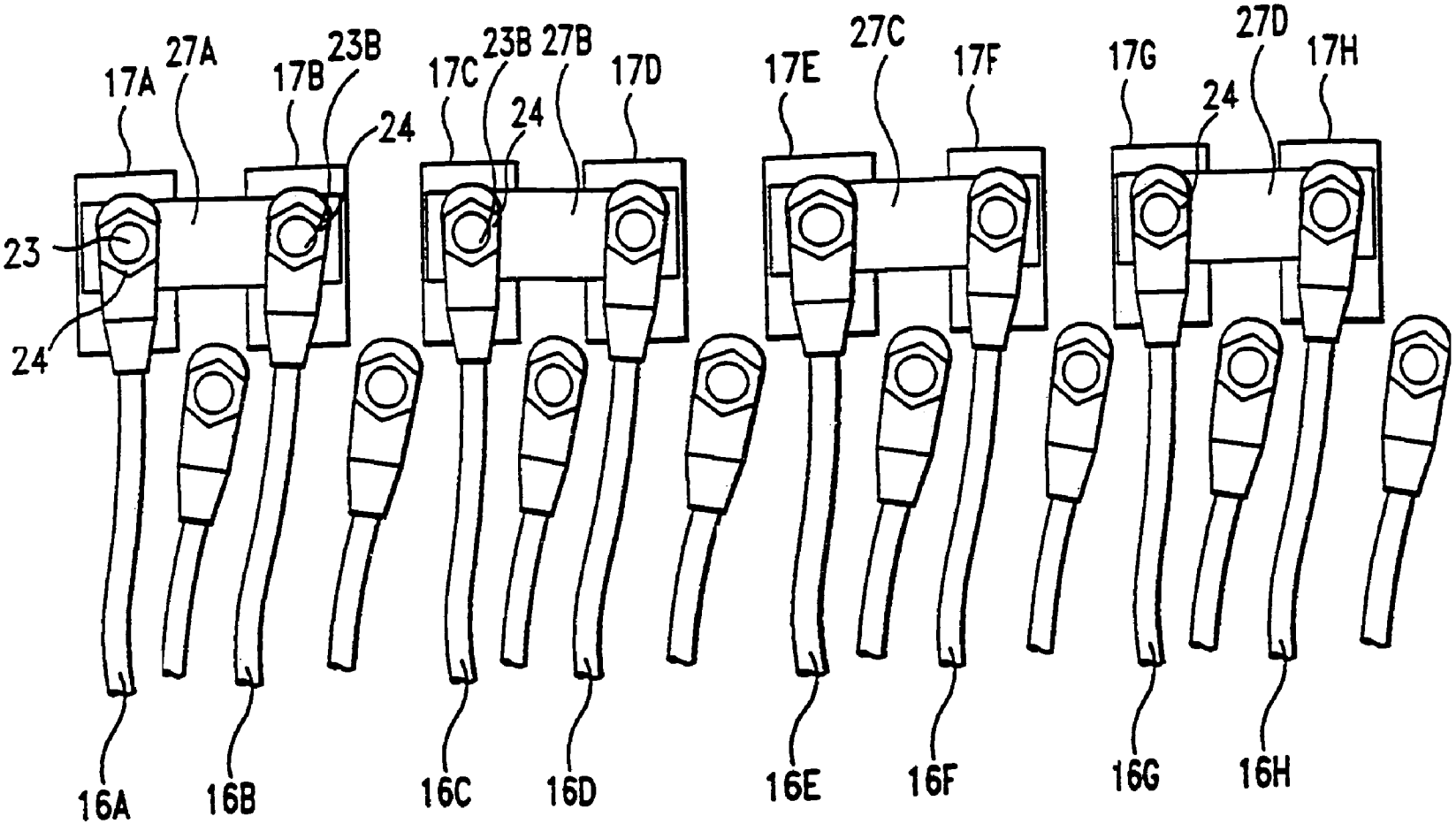
FIG. 3 is a top view of the power inputs of the burn-in board of FIG. 2 having a fixed power connector or jumper of the present invention installed.

The first embodiment of the present invention is especially shown in FIG. 3 and depicts a top view of the power inputs of the Burn-in board of FIG. 2 in which pairs of adjacent external power cables are interconnected by a fixed power connectors 27. The fixed power connector 27 of this invention is formed of a conductive material, such as copper, from flat stock that has a nominal thickness of 0.125 inches, a length of 1.65 inches and a width of 0.72 inches. These particular dimensions are for a connector to be used with the HPB-2 boards and HPB-2 ovens built by the Micro-Control Company of Minneapolis, Minn. Accordingly the connector is designed to span the distance between adjacent bolts 23 securing the cables 20 to the coupling plates or contacts 17 and holes 32, 0.25 inches in diameter, are formed 0.25 inches from each end of this base plate 35 at a point such the holes 32 will align with adjacent bolts 23. It should be understood that other boards and/or ovens built by either the same manufacturer or an another manufacturer may require different dimensions.

Thus as shown in FIG. 3 connector 27A is secured on the bolts 23A and 23B to interconnect cables 16A and 16B. Similarly the connector 27B is secured on the bolts 23C and 23D to interconnect cables 16C and 16D, connector 27C is secured on the bolts 23E and 23F to interconnect cables 16E and 16F and connector 27D is secured on the bolts 23G and 23H to interconnect cables 16G and 16G.

When the cables are provided with such connectors modules mounted on planes 11A, 11C, 11F and 11H can be operated up to supply 150 amps to modules inserted therein. If the modules inserted in planes 11A, 11C, 11F and 11H are expected to operate so as to draw up to 150 amps, the remaining planes 11B, 11D, 11E and 11G should not be used. In this way one half of the planes on a burn-in-board can be used to test modules at current levels up to to least twice that at for which the board was initially designed.

Although it is preferred that both sets of planes, i.e., planes 11A, 11C, 11F and 11H and planes 11B, 11D, 11E and 11G, not be loaded with modules simultaneously, it should be noted that in some instances both sets of planes, i.e., planes 11A, 11C, 11F and 11H and planes 11B, 11D, 11E and 11G, can have modules simultaneously inserted therein. In such a case it is necessary that the combined current draw of the modules inserted in each pair of coupled planes not exceed 150 Amps. This can be the case even when one of the paired modules exceeds 75 amps. For example if plane 11A has a module therein that draws 85 amps and its coupled plane 11B has a module therein that draws less than 65 amps both modules can be simultaneously treated on the same burn-in-board.

However the above process of converting such a burn-in-board to such coupled pairing as above described, although operable, required a time consuming install operation and once converted the burn-in-board could not be returned to its previous condition unless the install operation was reversed and the fixed connectors were removed. Since the conversion of just one eight plane burn-in board from a 75 ampere operation to a 150 ampere operation using the above fixed connectors required up to fifteen minutes, the conversion of sufficient boards for the smaller 16 board ovens requires three hours and any reversal to 75 amperes from 150 amperes required the same amount of time. For a larger thirty-two board oven such conversions requires twice as much time. Thus the use of such fixed connectors, although operable, required excessive conversion times during which both the burn-in-boards and the ovens remained inoperable. Thus although some economic advantage was realized it was marginal for the labor costs required for the conversions was significant.

Although the insertion of such fixed connectors and solved the problem, this process required time consuming install and/or removal operations that minimized the economic advantage realized by the conversion.

The present inventors persisted however and found that the desirable result of converting the burn-in-board to dual current uses could be inexpensively realized and the conversion time reduced from between twelve and fifteen minutes per board to less than one minute per board. This increased time advantage was achieved through the use of a plurality of unique split connectors of the second embodiment of the present invention which once installed need never be removed yet but can be swiftly altered thereby permitting selected ones of the power planes to quickly and easily be joined or separated to alter the applied current levels from either 75 amperes to 150 amperes or from 150 amperes back to 75 amperes.

Figure 4:
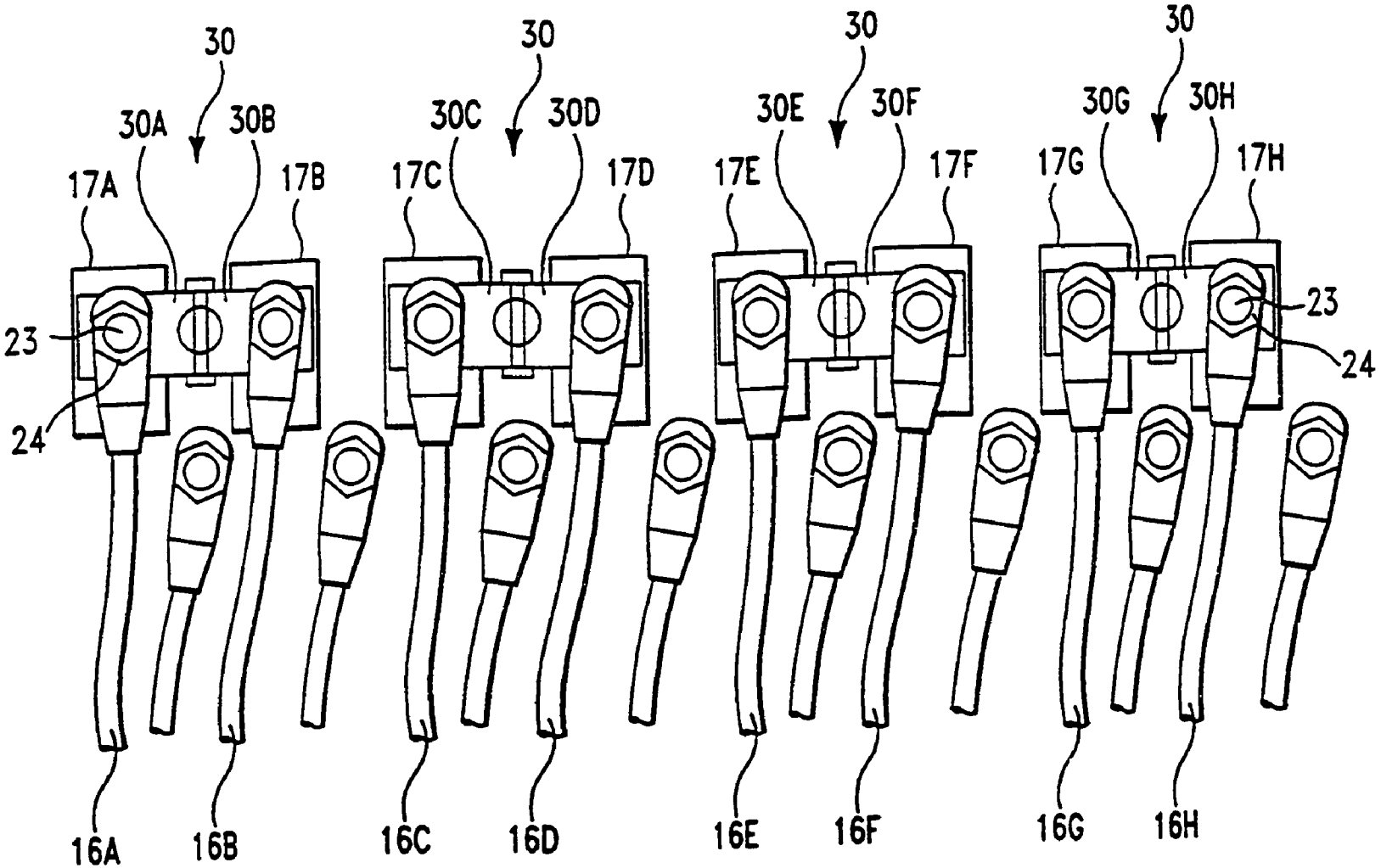
FIG. 4 is a top view of the power inputs of the burn-in board of FIG. 2 having the unique split high power, open/short connector of the present invention installed but left in its open condition.
Figure 5:
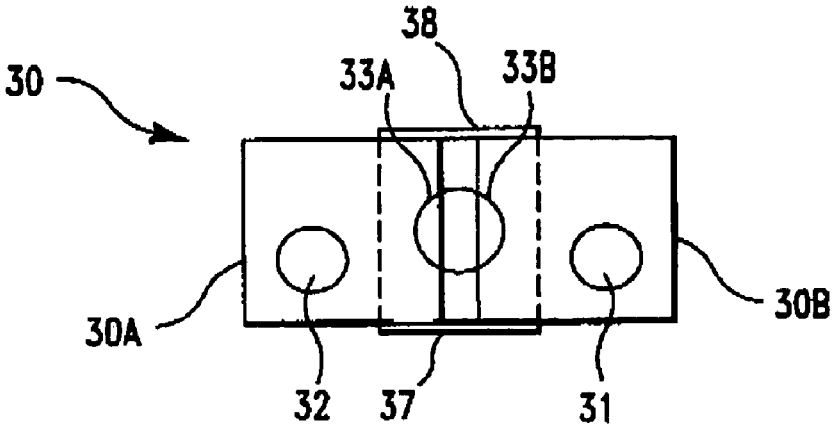
FIG. 5 is a top view of the base element of the split, high power, open/short connector of the present invention shown in FIG. 4.

Accordingly the inventors achieved such a result by creating and using a high power, open/short connector as shown in FIGS. 4, 5, 6, and 7 in place of the fixed connector shown in FIG. 3. As shown in FIGS. 4, 5, 6, and 7, the high power, open/short connector 30 of the present invention is again formed of a conductive material, such as copper, from a piece or strip of flat stock that has a nominal thickness of 0.125 inches, a length of 1.65 inches and a width of 0.72 inches. Again, these particular dimensions are for a connector to be used with the boards and HPB-2 ovens built by the Micro-Control Company of Minneapolis, Minn., and the high power, open/short connector is designed to span the distance between adjacent bolts 23*a* and 23B, 23*c* and 23*d*, 23*e* and 23F and 23*g* and 23*h* such that a high power, open/short connector can be connected between respective adjacent cables. As shown in FIG. 4 a high power, open/short connector 30 of the present invention respectively secures the cable 16A to the cable 16B, the cable 16C to the cable 16D, the cable 16E to the cable 16F and the cable 16G to the cable 16H. To do so apertures, such as holes, 32, of a diameter to fit over the bolts 23, are formed at each end of the base plate 30. Specifically, it is preferred that holes be used and be located 0.25 inches from each end of this base plate 30 at a point such the bolts 23, on adjacent power coupling plates 24, will be will aligned with and pass through the holes 32. Of course other apertures, such as notches in opposite ends of the strip can be used. A recess or trench 0.063 deep and 0.625 long is formed in the center of the lower surface of the base plate 30. A threaded vertical stud 33 having a circular cross section 0.250 in diameter is then secured to center of the base plate 30. The unit, now consisting of the base plate 30 and the vertical stud 33 carried thereby, is now sawn transverse, or across the width of the base plate and vertically through the center of the stud, to divide both the base plate and the stud carried thereon into two substantially equal parts. This accomplished by using a saw blade that will leave a kerf normally about 0.100 inches in width to form substantially mating base plate units 30A and 30B each of which carries a respective vertical mating stud portion 33A and 33B. Once separated the base plate units 30A and 30B and the respective mating stud portions 33A and 33B carried thereon can be mated and aligned by positioning then on an insulating inverted "T" shaped spacer 35. This spacer 35 is formed from any suitable insulating medium or material, for example, a phenolic material and is inserted between the two base halves 30A and 30B and the two stud halves 33A and 33B. The spacer 35 is especially shown in FIGS. 6 and 7 and its base is comprised of a "U" shaped channel provided with a vertical center fin 39. The channel 36 is 0.625 inches long, 0.820 wide and 0.0625 inches thick and provided with longitudinal side flanges 37 and 38 that are 0.01000 inches high and 0.050 inches wide so as to accurately position the opposing base units 30A and 30B. The fin 39 is centrally and vertically positioned on the base. The fin 39 is of a width identical to the original diameter of the stud 33 and of a thickness identical to the thickness of the saw used to cut the base 30 and the stud 33 in half. This done so that when the base units 30A and 30B are positioned properly in the "U" shaped channel 38 on either side of the fin 39 each base unit 30A and 30B and the respective stud portion 33A and 33B carried thereon will be aligned with but held in electrically isolation from the other by the spacer 35 and its fin 39. The fin 39 not only restores the stud to its original dimension but also causes any threads on the stud portions 33A and 33B to mate with one another. In this way the rejoined stud is realigned to its original thread diameter and thread configuration. It should be understood that burn-in boards and/or ovens made by other manufacturers may require dimensions different from those above described.

Figure 8:
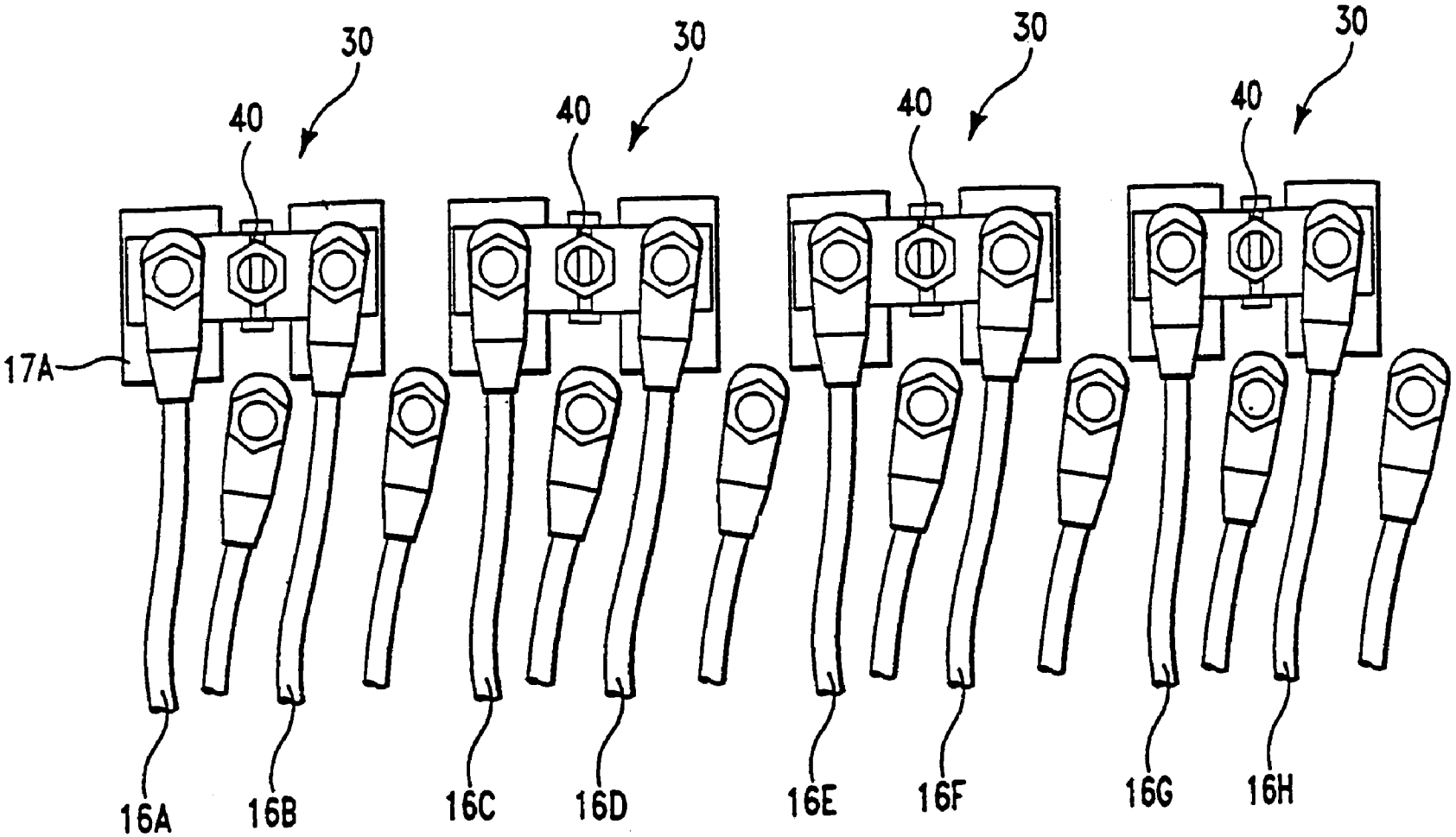
FIG. 8 is a top view of the power inputs of the burn-in board of FIG. 2 having the unique split high power, open/short connector of the present invention installed and placed in its shorted condition.

When the separate halves of each high power, open/short connector, of the present invention, are so mounted on the spacer 35 a coupling device such as a nut 40 can be placed on the rejoined stud 33 and the connector can be mounted between selected pairs of the coupling plates 17. Once mounted between the selected pairs of coupling plates the nut 40 can be removed and each half of the connection is again electrically isolated from the other half. Because the two halves of the open short connector are so isolated from each other, each plane 11A, 11B, 11C, 11*d*, 11E, 11F, 11G, and 11H remains operable at 75 amperes and modules can be placed on each plane and be tested up to 75 amperes. It should be understood that the width of the saw used to cut the base 30 and stud 33 in half must be such that when the spacer 35 is inserted there between the thickness and insulating properties must be sufficient to prevent the applied voltages and currents. However, when 150 ampere devices are to be tested, the coupling device, e.g., nut 40, having internal threads mating to the external treads on the rejoined stud 33, is threaded onto each split, insulated and rejoined stud, the insulation between the halves is bridged by the nut threaded thereon and the halves become electrically interconnected electrically interconnecting the adjacent cables bridged by the open/short connector of the present invention. When so connected or ganged either one of the now connected planes can provide up to 150 amps to a module inserted in one of the planes. Thus, as shown in FIG. 8, when coupling nuts 40 are threaded on each of the respective studs, the respective halves 30A and 30B, 30C and 30D, 30E and 30H, and 30F and 30G of each high power, open/short connector 30 are electrically bridged and their associated cables are interconnected. Thus when the nut 40A bridges and shorts together the high power, open/short connector halves 30A and 30B, the cables 16A and 16B are also electrically interconnected. Similarly when the high power, open/short connector halves 30C and 30D are connected by a nut 40B the cables 16C and 16D are interconnected and when the high power, open/short connector halves 30E and 30F are connected by a nut 40C the cables 16E and 16F are interconnected and the cables 16G and 16H are connected when the high power, open/short connector halves 30G and 30H have nut 40D secured thereon.

When the above described cables are so interconnected by the placing of the nuts 40A, 40B 40C and 40D on the appropriate rejoined studs, modules mounted on planes 11A, 11C, 11F and 11H can be operated up to 150 amperes. In this way one half of the planes on a burn-in-board can be used to test modules at current levels higher than normal i.e., in the present example higher than 75 amps. To reset the each of the ganged or combined pairs of planes to 75 ampere operation all that is required is to remove each respective coupling nut 40 from each of the high power, open/short connectors on which they were placed. Such removal takes less than one minute per burn-in-board. Thus once the high power, open/short connector of the present invention is initially installed on the burn-in-board the time need to switch the planes between different current levels is minimized resulting in a significant labor saving.

However, as discussed above, when the planes are ganged or combined as above described they can all be populated with modules that are expected to draw less 150 amps in combination. In such a case all the planes 11A, 11B, 11C, 11D, 11E, 11F, 11G and 11H can be used.

Although it is preferred to form the openings 31 and 32 offset to one side of the connector in order to identify the right and left hand sides of the open/short connector of the present invention other means to so identify the separate halves. Further by assuring the thread created on each stud 33 is always started on each stud at the same point and cut in the same position by a saw of the same thickness, the left side of the open/short connector, of the present invention, will always mate with the right side of any open/short connector of the present invention and means that exact matching of left and right sides is not necessary and assures that any right hand side 30A can be accurately joined to any left hand side 30B by any nut 40.

Figure 6:
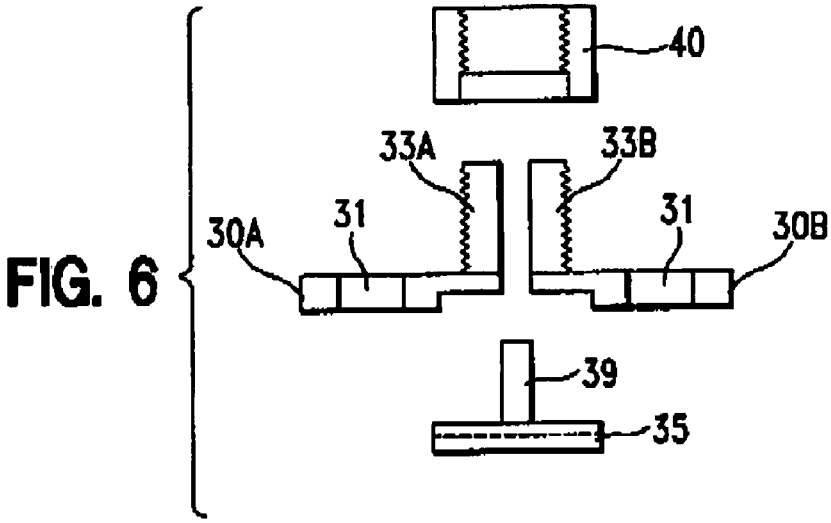
FIG. 6 is a exploded, longitudinal, cross-sectional view of the split, high power, open/short connector assembly of FIG. 5 provided with an insulating spacer.
Figure 7:
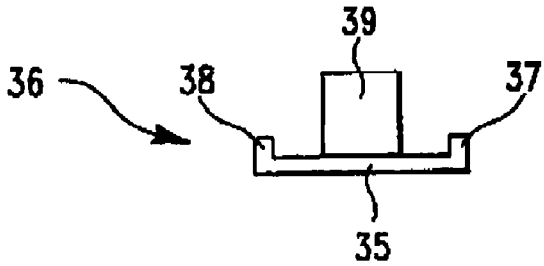
FIG. 7 is a side view of the insulating spacer of the split, insulated, high power open/short connector shown in FIG. 6 taken transverse to the view of the spacer shown in FIG. 6.

It has also been determined that if the nuts 40 is provided with a slight amount of thread relief 41 at the lower edge of the nut better electrical contact is assured between the nut 40 and right and left stud portions 30A and 30B. Such thread relief is realized by under cutting or removing the thread at the lower edge of the nut as shown in FIG. 6.

It should be further understood that the stud portions need not be circular, in cros section or threaded but can, for example, be tapered or otherwise shaped such that a suitable coupling device can be placed thereon to create an electrical short between the stud portions 30A and 30B. the stud need not be threaded but can, for example, be shaped such that a suitable coupling device can be used to electrically short the rejoined stud portions.

Other alternate features and solutions will now become obvious to one skilled in the art after review of the present invention.

This completes the description of the preferred embodiment of the invention. Since changes may be made in the above construction without departing from the scope of the invention described herein, it is intended that all the matter contained in the above description or shown in the accompanying drawings shall be interpreted in as illustrative and not in a limiting sense. Thus other alternatives and modifications will now become apparent to those skilled in the art without departing from the spirit and scope of the invention as set forth in the following claims.

What is claimed is:

1. An electrically apparatus for interconnecting a first power terminal to a second power terminal comprising:

first and second horizontal spaced apart conductive bases;

each of said bases having a first end and a second end;

said first base carrying at said first end a first respective vertical, conductive stud portion;

said second base carrying at said first end a second respective vertical, conductive stud portion;

said first base being connected to a first power terminal;

said second base being connected to a second power terminal; and an insulating insert positioned between said first base and said second base and extending between the first and second the vertical conductive stud portions thereon to maintain said bases and said stud portions in a fixed insulating position relative to each other and at a fixed distance apart; and a removable conductive coupler bridging said insulating said insulating insert to mechanically and electrically connect said first vertical, conductive stud portion secured to said first base to said second vertical, conductive stud portion secured to said second base.

2. The apparatus of claim 1 wherein said insulating insert is comprised of a "U" shaped channel having with longitudinal side flanges for maintaining the first and second bases in line with respect to each other; and a central fin narrower than said channel and centrally and vertically positioned in said channel to maintain said first stud portion a fixed distance from and in a fixed position relative to said second stud portion.

3. The apparatus of claim 1 wherein:

said first conductive base has a selected length having first and second ends, a selected width and a selected thickness less than said selected width;

said second conductive base has a selected length having first and second ends, a selected width and a selected thickness less than said selected width;

said first conductive stud portion secured to said first base at its second end;

said second conductive stud portion secured to said second base at its second end;

said first and second conductive stud portions carrying mating thread patterns thereon;

said first side of said first base being electrically connected to said first terminal; and said first side of said second base being electrically connected to said second terminal.

4. The apparatus of claim 1 wherein;

said connector has a vertical, threaded stud positioned thereon;

said strip and said stud carried thereon each being transversely split into first and second sides and secured together by said insulating insert the first side of said threaded split stud being affixed on the first side of said base;

the second side of said treaded split stud being affixed on the second side of said base;

said first side of said split base being electrically connected to said first respective power coupling contact and to said first respective power cable;

the second side of said split base being electrically connected to said second respective power coupling contact and to said second respective power cable; and a threaded coupling nut threaded on said split and rejoined stud to electrically connect said first and second respective power coupling contacts and to said first and second respective power cables.

5. A semiconductor testing apparatus comprising:

a burn-in oven having a plurality of burn-in-boards therein;

each of said burn-in-boards having a first and second module sockets thereon;

said first socket being coupled to a first external power carrying cable coupled to a first power coupling contact and to a first ground cable coupled to ground;

said second socket being coupled to a second external power carrying cable coupled to a second power coupling contact and to a second ground cable coupled to ground;

a connector comprised of an first and second strips, each of said strips carrying a respective one half of a divided threaded stud positioned vertically thereon;

the first said strip and the respective stud half carried thereon being aligned with but spaced apart with the second said strip and the respective stud half carried thereon by an inset formed of an insulating medium;

said first half of said split base being electrically connected to said first respective power coupling contact and to said first respective power cable;

the second half of said split base being electrically connected to said second respective power coupling contact and to said second respective power cable; and means for coupling said first and said second strips by a threaded coupling nut threaded on said first and second stud halves to electrically connect said first and second stud halves and the respective power coupling contacts to said first and second respective power cables.

6. A method of forming a device for selectively connecting and disconnecting a first power terminal to second power terminal consisting of the steps of:

selecting a first substantially flat conductive strip having a selected length and a selected width with first and second ends and a thickness less then said width;

forming an aperture passing through the thickness of said strip adjacent said first end and said second end;

securing a vertical stud having a selected diameter to the center of said strip between said apertures;

forming a screw thread on said vertical stud;

cutting said strip transversely to its length at the center of the strip to divide said strip and said stud into first and second substantially equal portions;

placing an insulating insert between said first and second substantially equal portions to align said first portion with said second portion and restore said stud to is selected diameter.

7. The method of claim 6 wherein said method further includes the step of placing a conductive nut on said restored stud to electrically interconnect said insulated portions.

8. The method of claim 7 wherein there is further provided the step of removing said conductive nut from said restored stud to electrically disconnect said insulated portions one from the other.

9. The method of claim 8 wherein said screw thread on said vertical stud is started at a known position.

* * * * *